US006030137A

United States Patent [19]

Thomas

[11] Patent Number: 6,030,137

[45] **Date of Patent: *Feb. 29, 2000**

[54] GLASS CLEANING APPARATUS HAVING A FABRIC CLEANING SURFACE

[75] Inventor: George H. Thomas, Fairborn, Ohio

[73] Assignee: Legrand Tour Group, Inc., Fairborn, Ohio

[ * ] Notice: This patent is subject to a terminal disclaimer.

[21] Appl. No.: 09/086,332

[22] Filed: May 28, 1998

Related U.S. Application Data

[63] Continuation of application No. 08/745,431, Nov. 12, 1996, Pat. No. 5,758,983.

[51] Int. Cl.[7] ..... A47L 13/26

[52] U.S. Cl. ..... 401/139; 401/137; 401/207

[58] Field of Search ..... 401/137, 139, 401/15, 207

[56] References Cited

U.S. PATENT DOCUMENTS

| | | | |
|---|---|---|---|
| 1,538,575 | 5/1925 | Mosman | 401/207 X |
| 1,543,412 | 6/1925 | Wood . | |
| 2,299,089 | 10/1942 | Haan . | |
| 2,532,429 | 12/1950 | Sparkman . | |
| 3,011,499 | 12/1961 | Tajan . | |
| 3,090,067 | 5/1963 | Weiby et al. . | |
| 3,133,301 | 5/1964 | Helminen . | |
| 3,226,760 | 1/1966 | Grote . | |
| 3,459,482 | 8/1969 | Fears | 401/15 |
| 3,981,106 | 9/1976 | Gallo | 401/207 X |
| 4,273,459 | 6/1981 | Hardy . | |
| 4,748,711 | 6/1988 | Markus . | |
| 4,807,322 | 2/1989 | Littledeer . | |
| 5,101,529 | 4/1992 | Tippie . | |
| 5,179,754 | 1/1993 | Stradnick . | |
| 5,758,983 | 6/1998 | Thomas | 401/15 |

FOREIGN PATENT DOCUMENTS

| | | | |
|---|---|---|---|
| 547033 | 5/1956 | Belgium . | |
| 1584178 | 12/1969 | France . | |
| 3530402 A1 | 6/1986 | Germany . | |
| 489596 | 1/1954 | Italy . | |
| 524877 | 4/1955 | Italy . | |
| 205977 | 10/1939 | Switzerland | 401/207 |
| 438054 | 11/1967 | Switzerland . | |

OTHER PUBLICATIONS

A copy of the Patent Cooperation Treaty International Search Report.

*Primary Examiner*—David J. Walczak
*Attorney, Agent, or Firm*—Maginot, Addison & Moore

[57] ABSTRACT

An apparatus for removing ice, frost or bugs from a glass surface includes a bottle having an outer surface and an end. The apparatus also includes a base attached to the end of the bottle and washer interposed between the bottle and the base. The apparatus further includes a guard extending from the washer so as to define a space interposed between the bottle and the guard. In addition, the apparatus includes a plurality of gripping members extending outwardly from the outer surface of the bottle. The gripping members increase the ergonomic efficiency of the apparatus. The base of the apparatus has flutes extending therefrom for the removal of ice or frost from a glass surface. Alternatively, the base can have a fabric attached thereto for the removal of bugs from a glass surface.

2 Claims, 9 Drawing Sheets

GLASS CLEANING APPARATUS HAVING A FABRIC CLEANING SURFACE

This application is a continuation of application Ser. No. 08/745,431, filed on Nov. 12, 1996 now U.S. Pat. No. 5,758,983.

CROSS REFERENCE

Cross reference is made to copending U.S. patent application Ser. No. 09/006,082, entitled "Apparatus for Cleaning Glass Having a Plurality of Gripping Members Defined Therein" by George H. Thomas.

BRIEF DESCRIPTION OF THE INVENTION

This invention involves ergonomically efficient, hand-held frost cutter and ice breaker assemblies. The frost cutter assembly incorporates a comfort (filler) washer between its upper bottle portion and its lower frost cutter portion. The ice scraper assembly has a finger protector guard between its bottle and ice breaker portion. Both the comfort washer and finger protector are interchangeable and have open space for assembling their respective structures. The bottle top has structures/protrusions or recessed, curved, concave surfaces with adjacent beveled surfaces, which are raised compared to said adjacent, curved concave surfaces, to aid in gripping same and lessening the force required to be exerted by the user, thus increasing the ergonomic efficiency of the devices. These devices can be fitted with bug remover fabric mesh associated with a foam backer and fitted onto "O" ring recesses using rubber "O" rings. The bottles can have a top, flat surface containing a logo or advertising placed thereon. Preferably the bottle portion can be clear plastic, viz., substantially transparent.

These devices are small and can be easily stored.

BRIEF DESCRIPTION OF THE DRAWINGS

As shown in FIG. 14, the bottom ice breaker fluted surface is concave and has a radius of curvature R substantially as shown to accommodate convexly curved windshields.

DETAILED DESCRIPTION OF THE INVENTION

Figure 1:
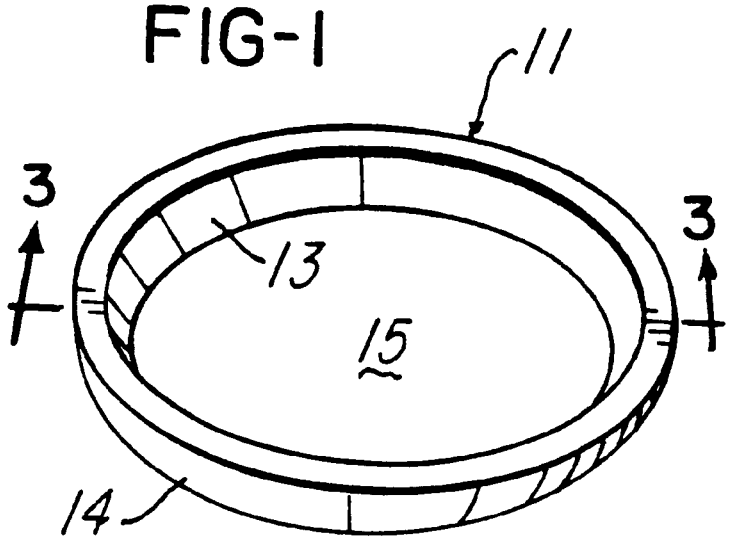
FIG. 1 is a perspective view of the comfort (filler) washer.
Figure 2:
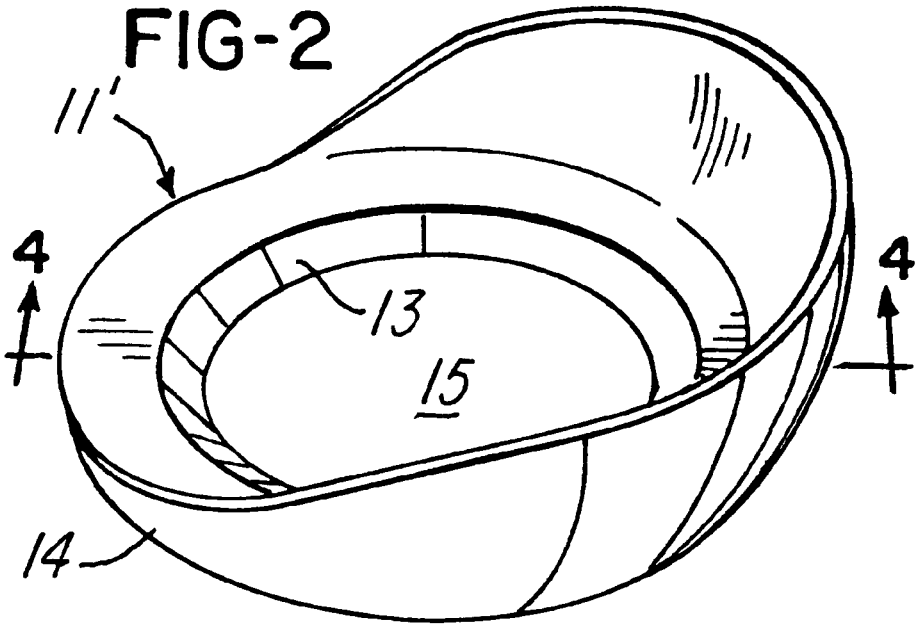
FIG. 2 is a perspective view of a finger protector guard.
Figure 5:
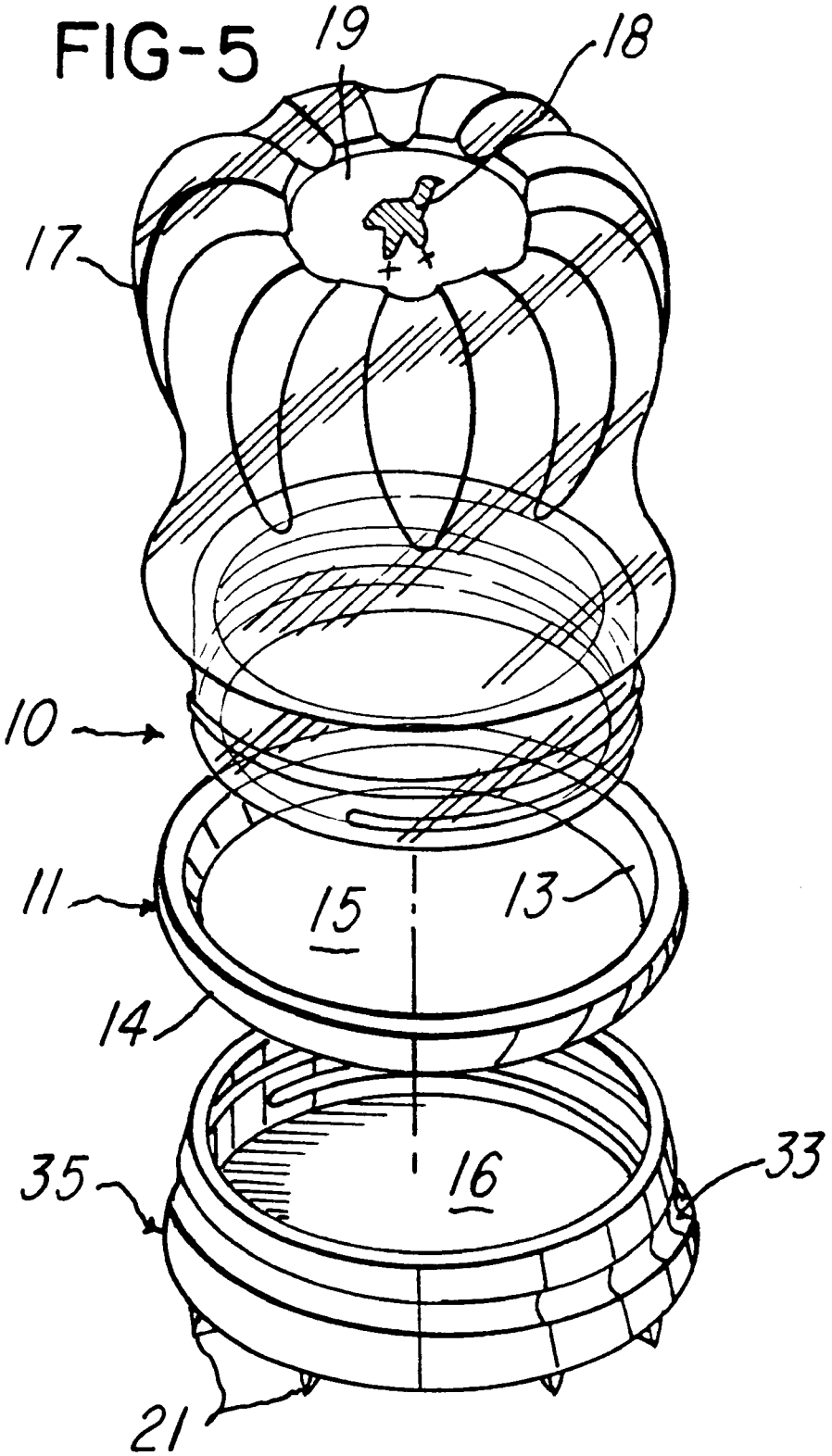
FIG. 5 is an isometric exploded view of the bottle with comfort (filler) washer and scraper assembly frost cutter.
Figure 6:
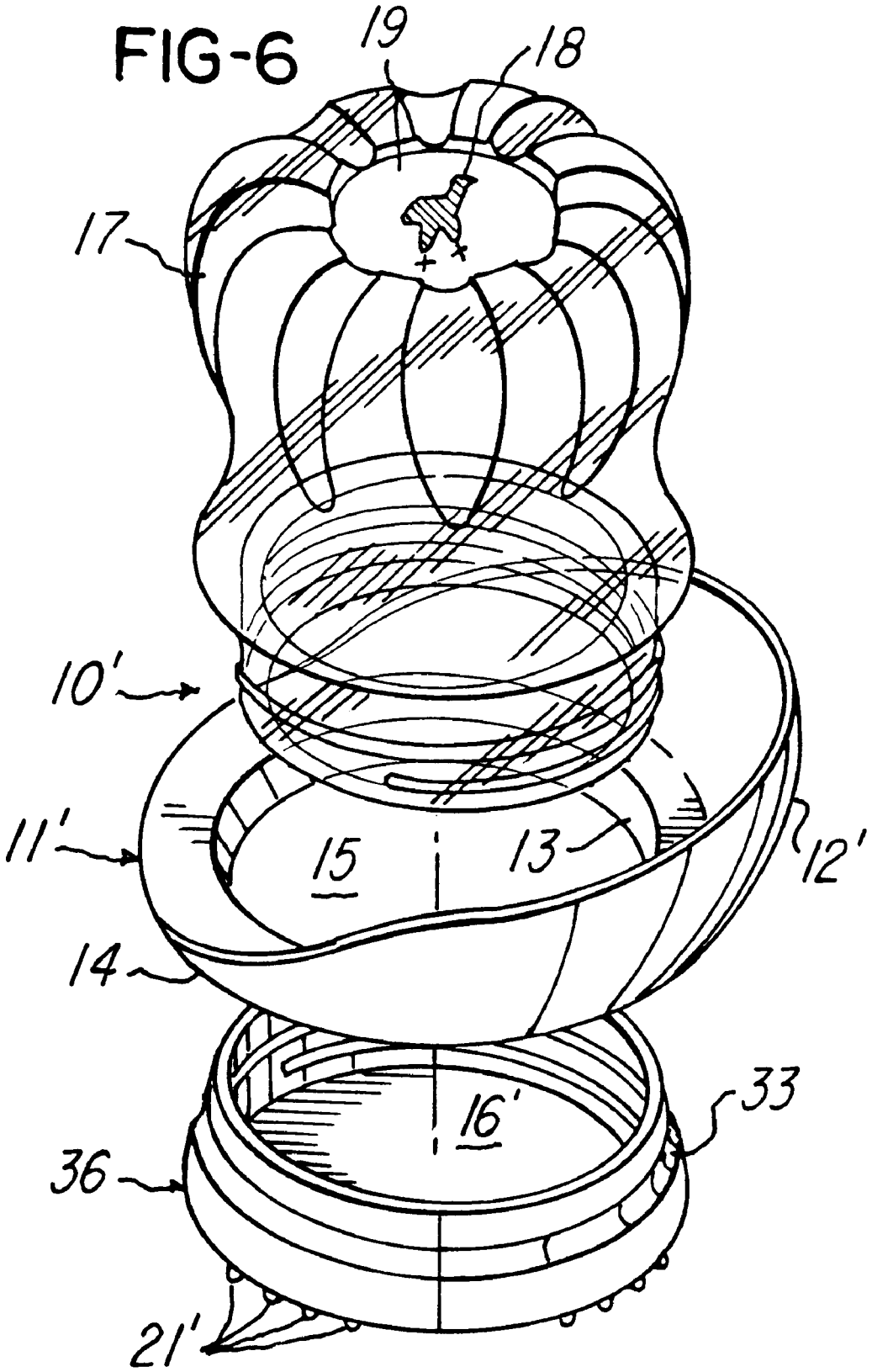
FIG. 6 is an isometric exploded view of a bottle with finger protector guard and scraper assembly ice breaker.
Figure 7:
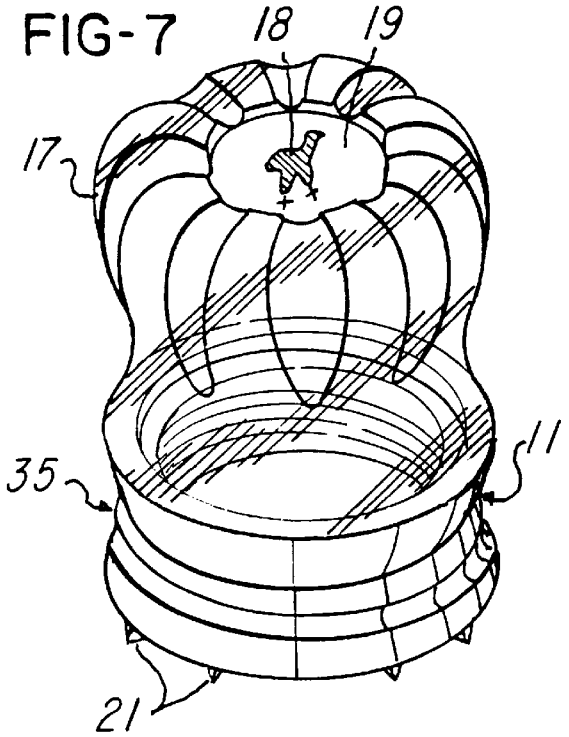
FIG. 7 is a perspective view of the assembled frost cutter of FIG. 5.
Figure 8:
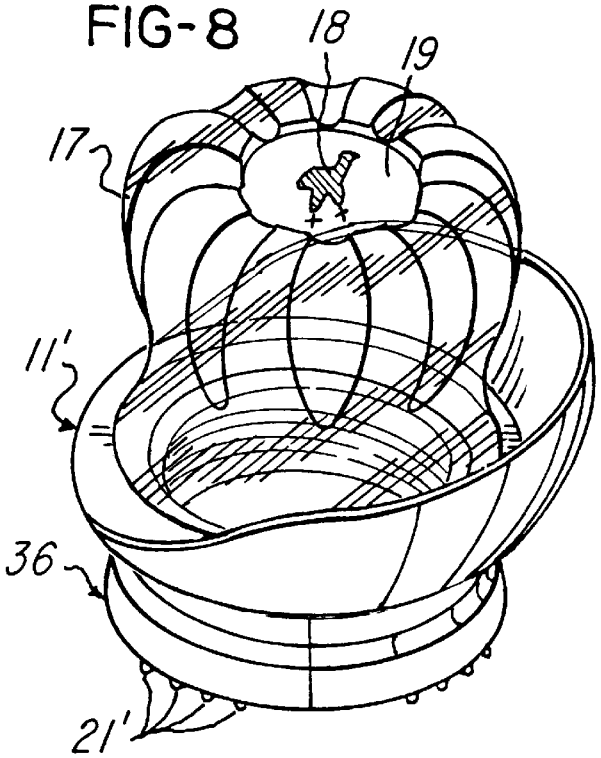
FIG. 8 is a perspective of the assembled ice breaker of FIG. 6.

As can be seen from the isometric views of FIGS. 5 and 6, FIG. 5 shows the bottle, comfort (filler) washer, and frost scraper assembly (10). FIG. 6 illustrates the bottle, finger protector guard and ice breaker assembly (10'). The comfort (filler) washer (11) is shown in FIG. 1. FIG. 2 shows finger protector guard (11').

Figure 3:
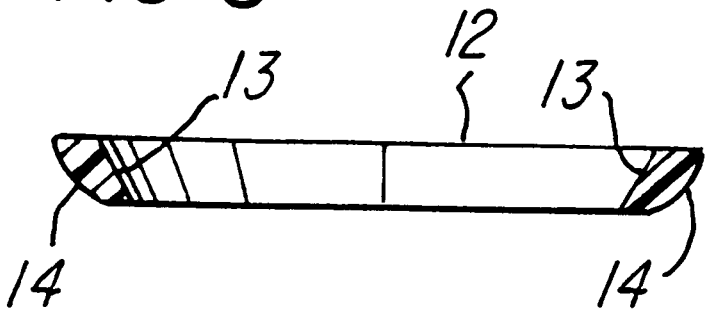
FIG. 3 is a cross-sectional view of the comfort (filler) washer taken along lines 3—3 of FIG. 1.

The cross-sectional view of the comfort (filler) washer (12) is shown in FIG. 3 having its beveled inner surface (13) and curved outer surface (14).

Figure 4:
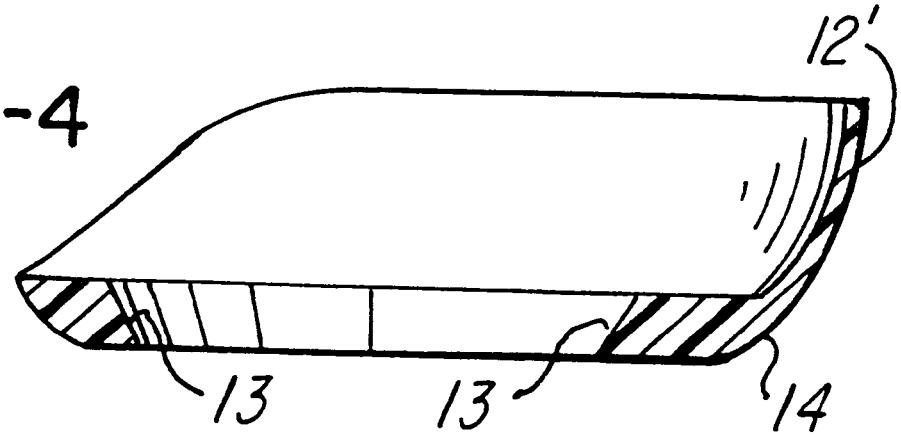
FIG. 4 is a cross-sectional view of the finger protector guard taken along lines 4—4 of FIG. 2.
Figure 9:
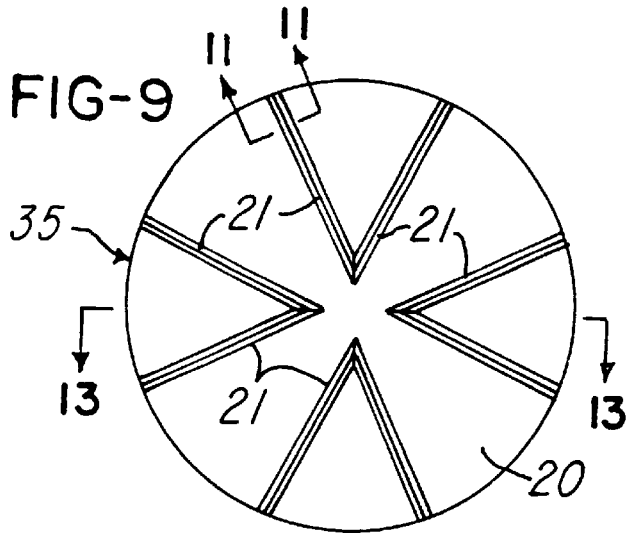
FIG. 9 is a bottom plan view of the frost cutter.

FIG. 4 of the drawings shows finger protector guard (12') having its beveled inner surface (13) and curved outer surface (14). Both the comfort (filler) washer and finger protector guard have open space (15) for assembling their respective structures FIGS. 1, 2, 5 & 6. Frost cutter solution containment base (35) has its lower solid portion (16) as shown in FIG. 5. Correspondingly, ice breaker solution containment base (36) has its lower solid portion (16)' as shown, for example, in FIG. 6. FIGS. 5 & 6 each show a bottle (17) with a bottle top flat surface (19) having placed thereon a logo (18). This arrangement is shown in FIGS. 5 through 8. FIG. 9 shows the bottom surface (20) of the frost cutter base and FIG. 10 shows the bottom surface (20') of the ice breaker base.

Figure 10:
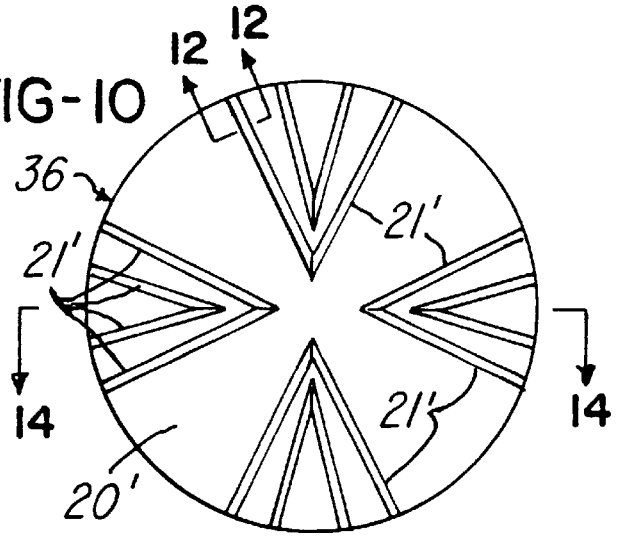
FIG. 10 is a bottom plan view of the ice breaker.

The scraper base flutes can be seen in cross-section from lines 11—11 of FIG. 9 whereas the ice breaker flutes can be seen from section lines 12—12 of FIG. 10.

Figure 11:
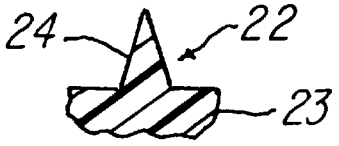
FIG. 11 is a cross-sectional view of the frost cutter flutes taken along lines 11—11 of FIG. 9.

FIG. 11 shows the frost cutting scraper flutes (22) as composed of scraper flutes base (23) and scraper flutes triangular extended portions (24) as shown from FIG. 11. This semi-flexible frost cutter accommodates glass surfaces, whether concave or convex. For example, the semi-flexible frost cutter can be used on the concave windshields on the outside and also on the convex surface windshields on the inside. These flutes can be made of semi-flexible polyethylene or equivalent plastic material.

The ice breaker round, semi-circular, convex, extended portions (24') can be made of hard polyethylene or equivalent plastic material. They are shown in FIG. 12 as having their lower base portions (23') and convex, semicircular extended portions (24').

Figure 12:
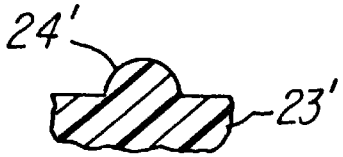
FIG. 12 is a cross-sectional view of the ice breaker flutes taken along lines 12—12 of FIG. 10. The space between the flutes of the ice breaker increase in width from the center to the outside to facilitate and to aid in the unloading of ice and frost build-up.
Figure 13:
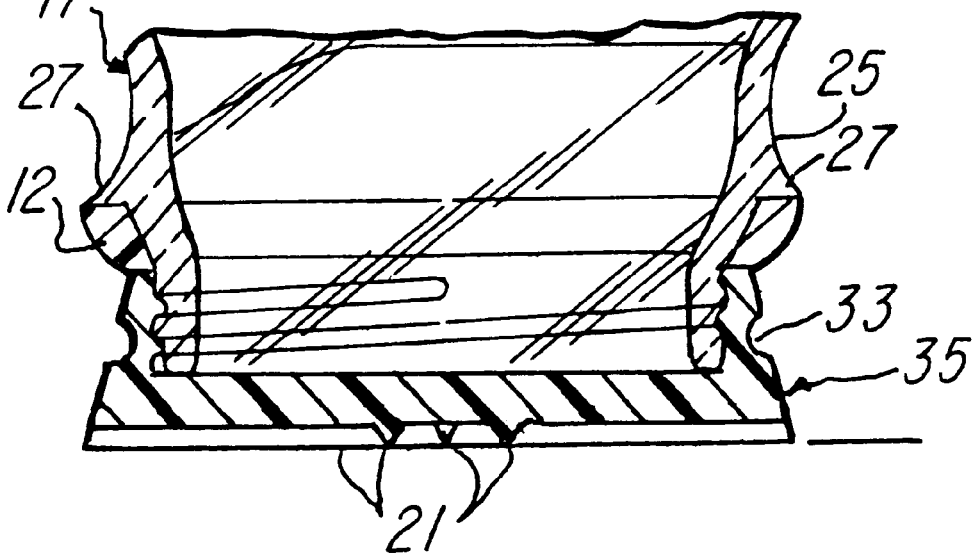
FIG. 13 is a partial cross-sectional view of the bottom portion of the frost cutter showing the lower bottle portion, comfort (filler) washer and beveled frost cutter, taken along lines 13—13 of FIG. 9.
Figure 14:
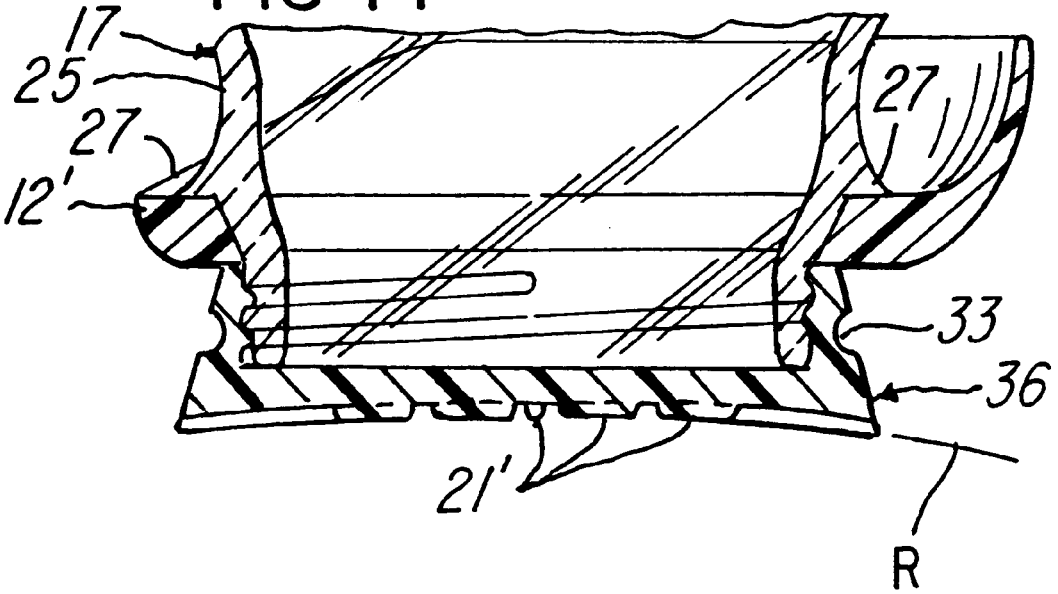
FIG. 14 is a partial cross-sectional view of the bottom portion of the lower bottle portion, finger protector guard and beveled ice breaker taken along lines 14—14 of FIG. 10.

Frost cutting flutes (22) (sectioned) can be seen in FIG. 11 whereas ice breaker flutes (24') can be shown sectioned in FIG. 12. The scraper flute base (23) and the ice breaker flutes base (23') are shown, respectively, in FIGS. 11 and 12.

As will be noted from FIG. 11 the semi-flexible frost cutter has scraper flutes which are triangular extended portions to accommodate glass surfaces, whether concave or convex. Thus they can be used on the concave windshields on the outside as well as on the convex surface windshields on the inside. The round, semi-circular, ice breaker flutes have extended portions (24') extending from their respective bases (23').

The bottles of both the frost cutter and the ice breaker assemblies can, and usually do, contain a solution to aid in dissolving road film on the inside and/or outside of the window. These bottle assemblies have a lower bottle portion (25) having a flared rim (27) and downwardly beveled sections (28) located beneath the respective flared rims (27) of each lower bottle portion. As will be noted from FIGS. 15 and 16, the downward bevel of each bottle lower portion is below its flared rim (27). Beneath each respective beveled portion (28) there are male threads (26) which are substantially parallel, yet slanted. This structure is apparent from FIGS. 13 through 16.

The outer surfaces of the bottle portions above flared rim (27) have exterior portions which aid in gripping said bottle portions. Thus FIG. 15 illustrates convex, semicircular protrusions (29) for this purpose and the structure of FIG. 16 illustrates the use of recessed, curved, concave surfaces and adjacent, beveled surfaces, which are raised compared to said adjacent, curved, concave surfaces, as shown at (30) to likewise aid gripping same and lessening the force required to be exerted by the user, thus increasing the ergonomic efficiency of the devices.

Figure 17:
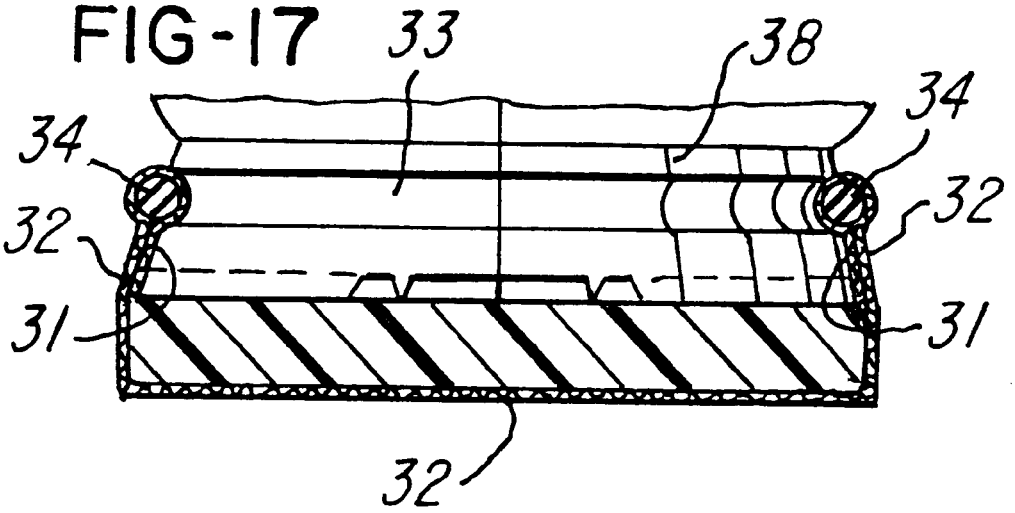
FIG. 17 is a cross-sectional view of the frost cutter lower portion with a bug remover fabric mesh having a foam backer with its inner and outer mesh portions wrapped around an "O" ring seated in its "O" ring recess between upper and lower beveled surfaces of the frost cutter bottom.

The devices of this invention can be fitted with bug remover fabric mesh, as is shown in FIG. 17. Such bug remover fabric mesh can have an inner portion (31) and an outer portion (32) as shown in FIG. 17. This bug remover fabric mesh can be fitted on to "O" ring recesses (33) such as are shown in FIGS. 5, 6, 7, 8, 13 & 14. The "O" rings, themselves, (34) can be made of rubber, or equivalent material.

FIG. 17 shows the bug remover fabric covering composed of inner fabric mesh portion (31) and outer fabric mesh portion (32) which are wrapped around rubber "O" ring (34) and foam backer (37) to be fitted onto the lower portion of the frost cutter and/or the ice breaker by placement of the rubber "O" ring (34) within its appropriate "O" ring recess (33).

Figure 15:
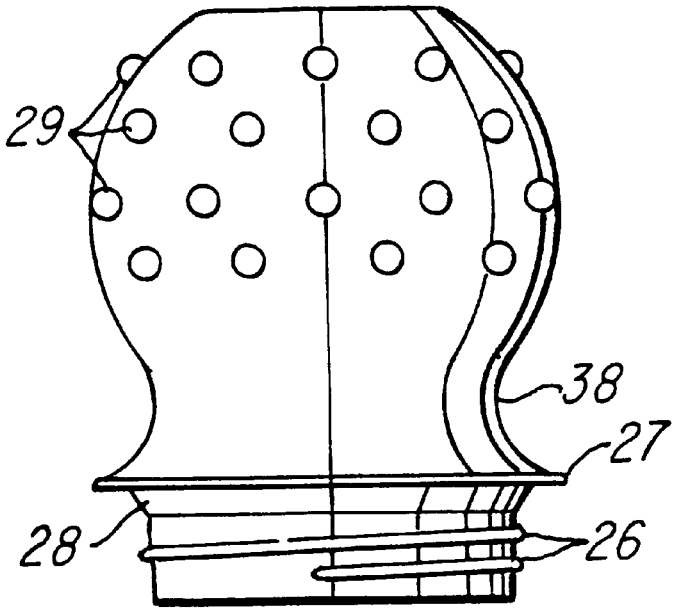
FIG. 15 is a perspective side view of the bottle portion showing convex, semi-circular protrusions with surrounding flat surfaces to aid in gripping and illustrating a lower, flared rim with downwardly beveled lower surfaces leading to lower, male, slanted threads.
Figure 16:
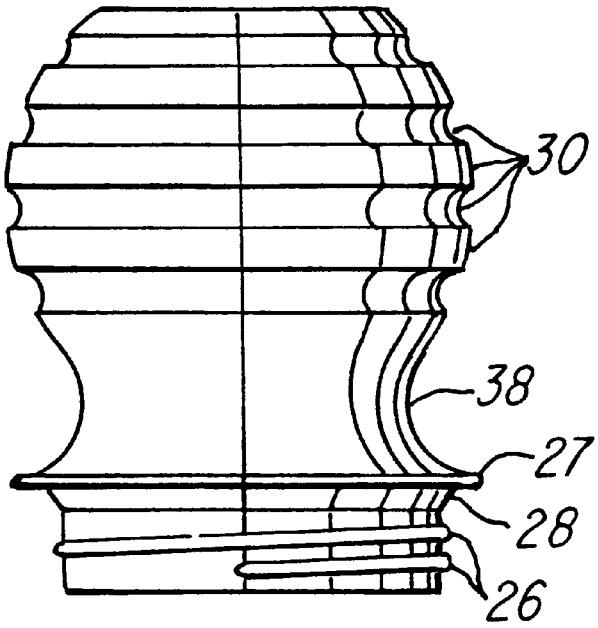
FIG. 16 is a perspective side view of the bottle portion showing recessed, curved, concave surfaces and adjacent beveled surfaces which are raised compared to adjacent curved, concave surfaces to aid in gripping and illustrating a lower, flared rim with downwardly beveled lower surface leading to lower, male, slanted threads.

Shade lines 38 are shown in FIGS. 15, 16 & 17.

In accordance with a preferred embodiment of this invention, the bottle portion of the assembly can be clear plastic, viz., substantially transparent. Thus this invention provides ergonomically efficient, hand-held frost cutter and ice breaker assemblies. The frost cutter assembly incorporates a comfort (filler) washer between its upper bottle portion and its lower frost cutter portion. The ice scraper assembly has a finger protector guard between its bottle and ice breaker portion. Both the comfort washer and finger protector are interchangeable and have open space for assembling their respective structures. The bottle top has structures (protrusions or recessed, curved, concave surfaces with adjacent beveled surfaces) which are raised compared to said adjacent, curved concave surfaces, to aid in gripping same and lessening the force required to be exerted by the user, thus increasing the ergonomic efficiency of the devices. These devices can be fitted with bug remover fabric mesh associated with a foam backer and fitted onto "O" ring recesses using rubber "O" rings. The bottles can have a top, flat surface containing a logo or advertising placed thereon. Preferably the bottle portion can be clear plastic, viz., substantially transparent.

These devices are small and can be easily stored.

What is claimed is:

1. An apparatus for cleaning glass, comprising:

a bottle having (i) a chamber defined therein for containing a liquid, and (ii) an access opening through which said liquid may enter and exit said bottle;

a base removably attached to said bottle, said base (i) being configured to completely cover said access opening when said base is attached to said bottle, and (ii) having a recess defined therein;

a fabric secured to said base such that said fabric (1) covers a bottom surface of said base when said base is attached to said bottle, and (2) a portion of said fabric is positioned within said recess; and a washer interposed between said bottle and said base, said washer including a guard which is spaced apart from said bottle so as to define a protective space between said bottle and said guard whereby fingers of a user's hand are positioned in said protective space when a user's hand grasps said bottle.

2. An apparatus for cleaning glass, comprising:

a bottle having (i) a chamber defined therein for containing a liquid, and (ii) an access opening through which said liquid may enter and exit said bottle;

a base removably attached to said bottle, said base (i) being configured to completely cover said access opening when said base is attached to said bottle, and (ii) having a recess defined therein;

a fabric secured to said base such that said fabric (1) covers a bottom surface of said base when said base is attached to said bottle, and (2) a portion of said fabric is positioned within said recess;

a number of ice engaging members which are attached to and extend from said bottom surface of said base, wherein said fabric is attached to said base so as to cover said number of ice engaging members; and a foam backer interposed between said number of ice engaging members and said fabric.

* * * * *